US006682274B2

(12) United States Patent
Vötsch et al.

(10) Patent No.: US 6,682,274 B2
(45) Date of Patent: Jan. 27, 2004

(54) CUTTING INSERT WITH WEAR DETECTION

(75) Inventors: Wolfgang Vötsch, Rangendingen (DE); Jörg Drobniewski, Mössingen (DE)

(73) Assignee: Walter AG, Tubingen (DE)

( * ) Notice: Subject to any disclaimer, the term of this patent is extended or adjusted under 35 U.S.C. 154(b) by 0 days.

(21) Appl. No.: 09/968,614

(22) Filed: Oct. 2, 2001

(65) Prior Publication Data

US 2002/0039521 A1 Apr. 4, 2002

(30) Foreign Application Priority Data

Oct. 2, 2000 (DE) ..... 100 48 899

(51) Int. Cl.[7] ..... B23B 27/14; B23P 15/28
(52) U.S. Cl. ..... 407/118; 407/119
(58) Field of Search ..... 407/113, 114, 407/115, 116, 117, 118, 119, 120

(56) References Cited

U.S. PATENT DOCUMENTS 4,357,382 A * 11/1982 Lambert et al. ..... 428/212
4,701,384 A * 10/1987 Sarin et al. ..... 428/688
5,597,272 A * 1/1997 Moriguchi et al. ..... 407/119
5,776,588 A * 7/1998 Moriguchi et al. ..... 428/210
5,834,061 A * 11/1998 Ljungberg ..... 427/255.34
5,861,210 A * 1/1999 Lenander et al. ..... 428/336
6,015,614 A * 1/2000 Ruppi ..... 428/335

FOREIGN PATENT DOCUMENTS

DE 197 24 319 10/1998
EP 0908259 4/1999

* cited by examiner

*Primary Examiner*—Henry W. H. Tsai
(74) *Attorney, Agent, or Firm*—Burns, Doane, Swecker & Mathis, LLP

(57) ABSTRACT

A cutting insert is provided with a combination coating, comprising a wear-protection coating and an indicating layer. The indicating layer preferably is provided on the tool flank or flanks, meaning for radial inserts on the side surfaces and for tangential inserts on the bottom or top surface. The indicating layer is sensitive enough, so that even a short-term use of the adjacent cutting edge leaves clear traces on the indicating layer. In the process, the indicating layer is discolored and/or worn down, so that underlying layers or materials with different colors become visible. As a result of the clear color contrast or brightness contrast, used cutting edges can be identified immediately. The use of the tool flanks as indicating surfaces has proven to be particularly advantageous because a tribological and possibly unfavorable coating can be provided, without this having a negative influence on the processing result of the cutting insert.

6 Claims, 2 Drawing Sheets

CUTTING INSERT WITH WEAR DETECTION

CROSS REFERENCE TO RELATED APPLICATION

This application claims the priority of German patent Application No. 100 48 899.4 filed Oct. 2, 2000, which is incorporated herein by reference.

BACKGROUND OF THE INVENTION

The invention relates to a cutting insert, such as the ones used in cutting tools for the machining of work pieces.

Milling cutters and other tools used for the machining of work pieces are frequently provided with one or several cutting inserts, which have a certain limited service life and therefore must be exchanged from time to time. Cutting inserts with only one cutting edge are replaced at that time. Cutting inserts with several cutting edges frequently can be turned inside the holder, meaning the insert can be turned to allow a cutting edge, which has not yet been used, to be placed in the active position. If necessary, the cutting insert can be used further by inserting it into a different holder to allow the use of a previously unused cutting edge.

Caution must be exercised with the above-described operation to prevent previously unused cutting edges from being turned or replaced, as well as to prevent that previously used cutting edges are not detected and are overlooked when replacing or turning the cutting inserts.

A cutting insert provided with a combination coating is disclosed in European Patent reference EP 0908259 A2. The chip surface is provided with a material that is not sensitive to impact and has a wear-reducing top surface with a low frictional value. The flank surface, on the other hand, is provided with a cutting material or a cutting material composition with higher abrasion resistance and hardness than the cutting material or the cutting material combination of the coating on the machining face. This is intended to improve the flank wear as well as the top surface quality and the dimensional accuracy of the work piece.

The above-explained problems are not solved with this method.

Thus, it is the object of the invention to create a cutting insert, which makes it easier to maintain the machining tools, in which this cutting insert is used.

SUMMARY OF THE INVENTION

The above object generally is achieved according to the present invention by a cutting insert comprising: a basic body including a bottom surface, side surfaces, and a top surface, of which at least one surface functions as a machining face and at least one other surface functions as a tool flank, a wear indicating layer provided on the tool flank, with the wear indicating layer having a color that differs from the color of the underlying flank surface.

The flank or flanks of the cutting insert according to the invention is (are) provided with a wearable indicating layer, having a color that differs from the color of the surface or layer underneath. The highest possible color contrast is aimed for in this case. The indicating layer deposited on the flank has a composition that clearly shows machining traces, if possible after only a short operating time of the cutting insert. For example, clear traces should appear after just a few minutes of a machining operation and the coating should be removed at least partially, so that the underlying base with different color becomes visible. The indicating layer of a possible embodiment is therefore not wear-resistant. On the contrary, that indicating layer is relatively sensitive to wear; e.g. it can have poor adherence to the base layer. However, it also possible to provide a well-running indicating layer that changes color as soon as the cutting insert is used.

The indicating layer can additionally or instead be sensitive in other ways in order to show that the respective neighboring cutting edge has already been used. For example, the indicating layer can be heat-sensitive and can show a change in color when heated above a limit temperature of 200° C., for example, which occurs only in the vicinity of an active cutting edge. The color can change due to oxidation or other changes and is preferably irreversible. If the neighboring cutting edge was used only briefly and the corresponding flank area that adjoins the cutting edge has assumed at least briefly a temperature above the limit temperature, then the indicating layer changes to the color which remains visible over the long range. The advantage of a color change due to thermal effects is that even those flank areas that do not come into direct contact with the work piece during the operation change color.

Due to the aforementioned indicating layer, it is easy to see whether the cutting inserts of a cutting tool have already been used and which cutting edges are still unused, so that the cutting inserts can be replaced or turned. In particular, it is possible to avoid overlooking already used cutting inserts during the maintenance, or to replace unused cutting inserts, or to move previously used cutting edges again to the active position when turning the cutting inserts, or for unused cutting edges to remain unused. The maintenance of respective cutting tools is thus considerably simplified with the cutting insert according to the invention.

The indicating layer is preferably of a light color, e.g., yellow or with a silvery shine, whereas the machining face is preferably of a dark color. The machining face is preferably provided with an aluminum oxide coating ($Al_2O_3$), wherein additional layers can be provided underneath or on top of the $Al_2O_3$ layer. The cutting insert thus can be coated with several layers, wherein the $Al_2O_3$ layer forms the wear-reducing layer. However, it can also have additional top layers. Other wear-resistant layers with the same or better properties can also be provided in place of the $Al_2O_3$ layer.

In order to produce a cutting insert according to the invention, it is preferable if a wear-reducing coating, which may contain an $Al_2O_3$ layer, is initially applied to the complete basic body, meaning to the side or flank surfaces, the top surface and, if necessary, also the basic surface. For example, a nitrite-containing layer can be deposited as the top layer (e.g., TiN). This layer is preferably provided so as to cover the complete surface and is then removed from those surface areas, which are subjected to higher wear. The nitrite-containing layer, intended to serve as an indicating layer, in particular is preferably removed from the machining face through mechanical wear, e.g., a brushing operation or jet blasting (sand blasting). It is preferable if not only the machining face, but also the adjoining cutting edge is exposed, so that the indicating layer does not extend completely to the cutting edge.

The processing with a brush or jet at the same time represents a reworking of the cutting edge and the machining face, which simultaneously smoothes the coating in the area of the cutting edge and the machining face. This has a favorable effect on the machining sequence and helps increase the service life.

Advantageous details of the invention are the subject matter of the dependent claims and follow from the drawing or specifications.

An exemplary embodiment of the invention is illustrated in the drawing.

DETAILED DESCRIPTION OF THE PREFERRED EMBODIMENTS

Figure 1:
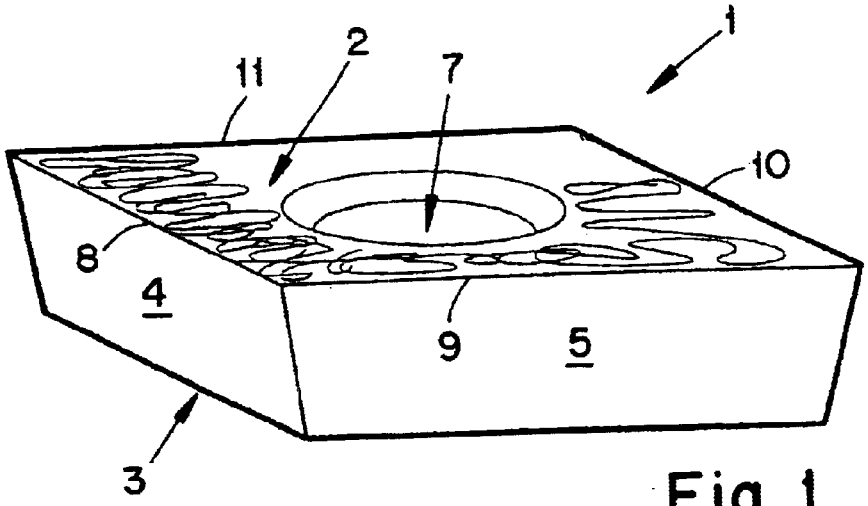
FIG. 1 shows a cutting insert with an indicating layer on its tool flank, shown in a perspective representation before its first use.

The cutting insert 1 shown in FIG. 1 is designed as rectangular insert and comprises a base body 2, for example, produced of a hard metal. The base body 2 can consist of a sintered tungsten carbide or another hard material. However, the base body 2 can also be made of a ceramic material.

The cutting insert 1 has a bottom surface 3, several side or flank surfaces 4, 5 and a top surface 6. A through bore 7 that functions as a fastening bore extends through the top surface 6 and the bottom surface 3. Other fastening means or options can also be provided, if necessary, in addition to or in place of the fastening bore.

For the intended use of cutting insert 1, the top surface 6 forms the machining face, while the side surfaces 4, 5 form the tool flanks. The cutting edges 8, 9, 10, 11, formed between the machining face 6 and the flanks 4, 5, are designed to be straight for the present exemplary embodiment.

The machining face 6 is shown herein as a level surface. If necessary, it can also contain additional structures such as chip recesses, chip breakers or the like. The same is true for the flanks 4, 5, which are shown in FIG. 1 as level surfaces. If need be, these flanks can be shaped as facets (divided into surface regions) or have a shape that deviates otherwise from the level surface.

Figure 4:
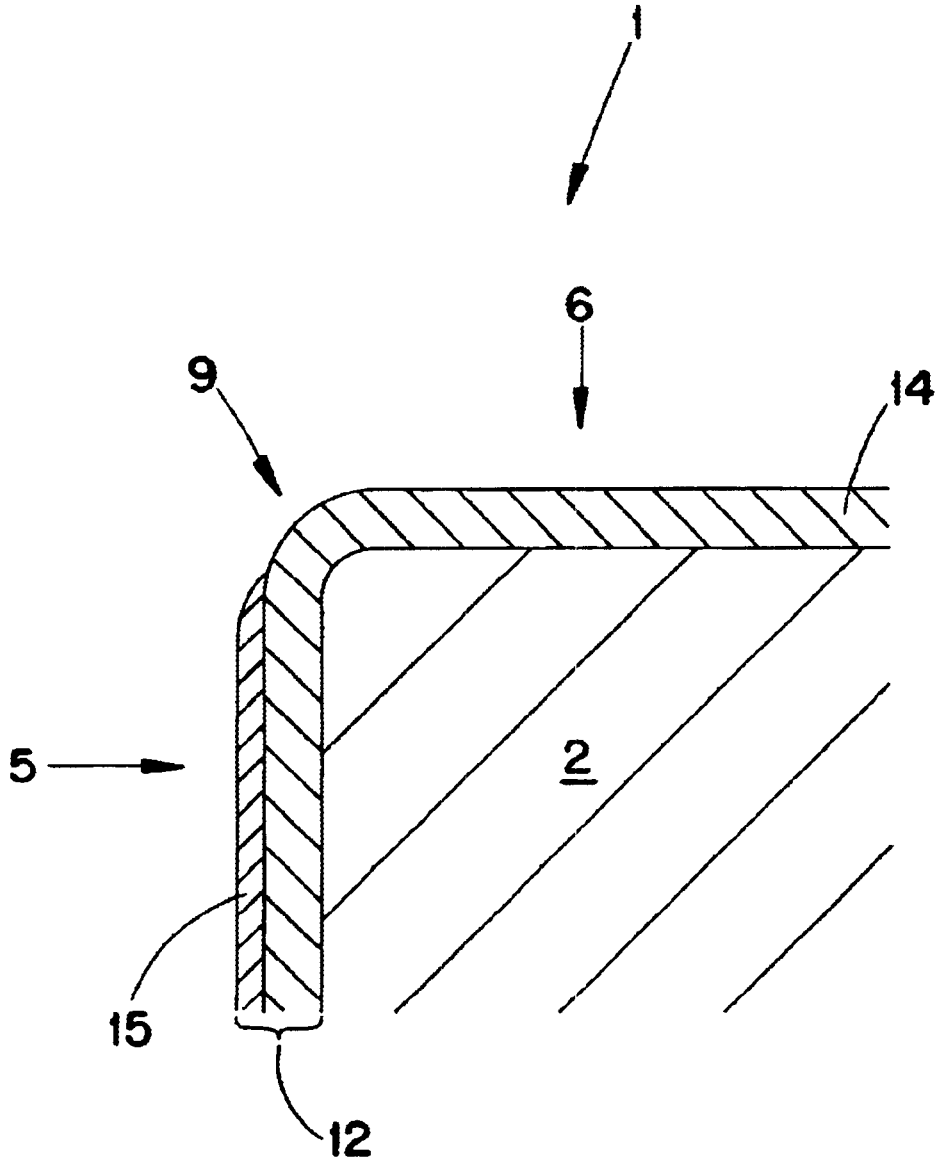
FIG. 4 shows the cutting insert according to FIG. 1, in a detailed sectional view on a different scale.

The cutting edges 8, 9, 10 and 11 can deviate in longitudinal direction from the straight line, if necessary, and can be curved or bent. In transverse direction, they are rounded to answer its purpose, as shown in FIG. 4 for example, in which the cutting edge 9 is illustrated as a representative edge for the other cutting edges. FIG. 4 furthermore shows the composition of a coating 12, provided on the cutting insert 1. The coating includes a basic layer 14, which extends over the side surface 5 as well as the top surface 6. The basic layer 14 can be composed of several layers and forms a wear-reducing coating. For example, this layer can be composed of or can contain $Al_2O_3$. A basic layer can initially be deposited on the base body 2, which is then covered with a bonding layer, on which the $Al_2O_3$ layer is deposited. This three-layer system on the whole forms the wear-protection coating 14.

The coating 12 furthermore comprises an indicating layer 15, which is provided on the flank 5, at least adjoining the cutting edge 9. For the present embodiment, the indicating layer 15 is a titanium nitride layer, which has a yellow or brassy color. In contrast, the wear-protection coating 14 underneath is black or dark.

The indicating layer 15 has no optimum tribological properties and is relatively thin. During the production of the cutting insert 1, this layer is deposited on the wear-protection coating 14 and has been removed again at least from those surface areas, for which the tribological properties of the wear-protection coating 14 are required. In particular, this concerns the portion of machining face 6, which comes in contact with the chips. The indicating layer 15 can be removed from the machining face 6 with chemical or physical or mechanical processes, for example, by using brushes or other abrasive methods for removal, such as sand blasting. A jet blasting of this type furthermore has a smoothing effect on the wear-protection coating 14, which is exposed once more in this way, as well as the cutting edge 9.

In the unused condition, the herein described cutting insert 1 has intact tool flanks 4, 5, as shown in FIG. 1. In particular adjoining the cutting edges 8, 9, these tool flanks still have the original coloring, thus indicating that the cutting edges 8, 9 have not yet been used. In the case of a TiN coating of the flanks 4, 5, the indicating layer adjoining the cutting edges 8, 9 is a luminous brassy yellow. In contrast, the machining face 6 looks like a typical $Al_2O_3$ coated cutting insert, meaning it is relatively dark to nearly black.

Figure 2:
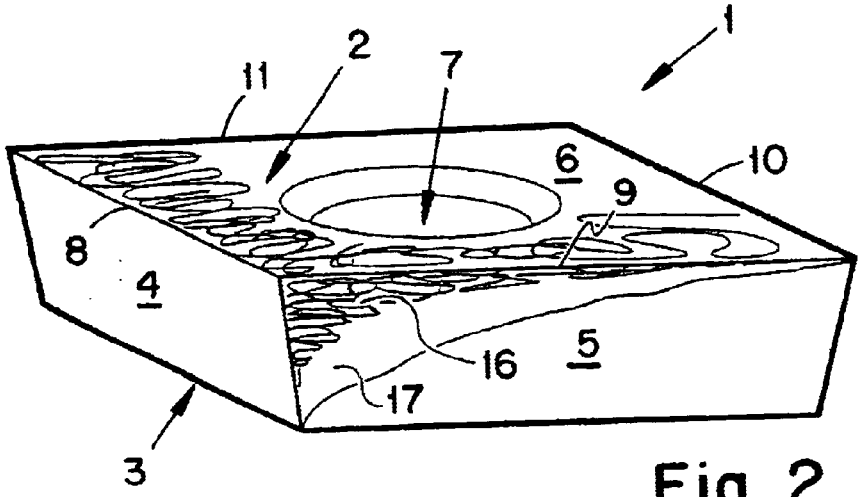
FIG. 2 shows the cutting insert according to FIG. 1, after several minutes of operation for its first cutting edge, shown in a perspective view.
Figure 3:
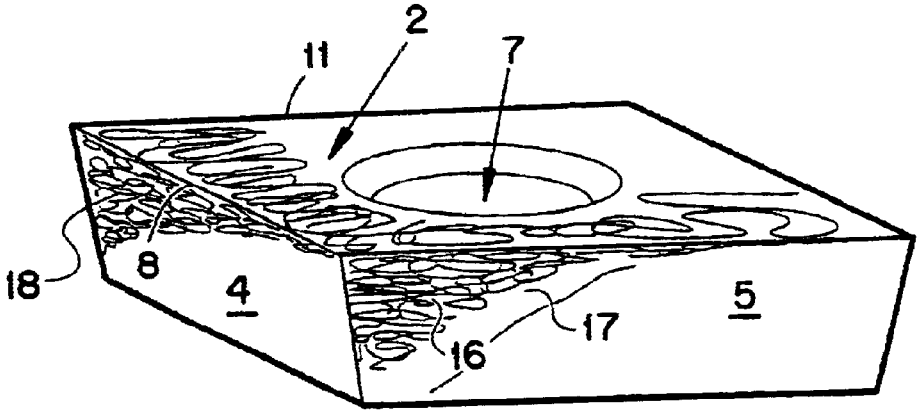
FIG. 3 shows the cutting insert according to FIGS. 1 and 2, following the use of two cutting edges.

For a further explanation, we proceed on the assumption that the cutting insert 1 is installed in the body of a cutting tool, in such a way that the cutting edge 9 forms an active cutting edge. As soon as the cutting tool is used, the cutting edge 9 comes in contact with the material of a work piece and, accordingly, starts the machining of the work piece material. The wear on the cutting insert is low as a result of the wear-protection coating 14, particularly in the region of the cutting edge 9 and the machining face 6. The tool flank 5, however, is subject to a relatively high starting change, insofar as the indicating layer 15 discolors in the region of the cutting edge 9. A different color is obtained in the discolored regions, as compared to the indicating layer 15, and a noticeably darker wear-protection coating 14 may become visible. As a result, dark discoloration and wear regions 16 form adjacent to the cutting edge 9, as shown in FIG. 2, which can be detected immediately and are easy to see. The discoloration is due to changes caused by thermal effects, for example resulting from oxidation manifestations. FIG. 2 shows that discolored regions 17, for example, can form as a result of the indicating layer 15 taking on oxidation tints in these regions. The oxidation tints can be caused by the heating up of the cutting insert due to the machining of the work piece with the cutting edge 9. Following a longer use, the tool flank 5 can assume the appearance shown in FIG. 3. However, the appearance shown in FIG. 2 is reached after only a few minutes of the machining operation, so that the operating personnel can determine at first glance that the cutting edge 9 has already been used while the cutting edge 8 is still completely unused. Once this cutting edge has also been subjected to a first use, it offers the appearance as shown in FIG. 3. In that case, the tool flank 4 adjacent to the cutting edge 8 is also provided with a dark region 18 that indicates that the cutting edge 8 has been used.

The cutting insert 1 is a reversible or indexable cutting insert with four usable cutting edges 8, 9, 10, 11. As a result of the indicating layer 15, it is obvious at first glance, which of the cutting edges 8, 9, 10, 11 have already been used and which are still new. The maintenance of cutting tools provided with cutting inserts of this type is particularly easy.

A combination coating is provided for a cutting insert 1, which comprises a wear-protection coating 14 and an indicating layer 15. The indicating layer is preferably provided on the tool flank(s), meaning with radial inserts on the side surfaces and with tangential inserts on the bottom or top surface. The indicating layer 15 is sensitive enough, so that even a short-term use of the neighboring cutting edge 8, 9, 10, 11 leaves clear traces on the indicating layer 15. As a result, the indicating layer is discolored and/or worn, thereby allowing the differently colored layers or materials underneath to become visible. The clear color contrast or brightness contrast makes it possible to identify used cutting edges immediately. The use of tool flanks as indicating surfaces has proven to be particularly advantageous because they can be provided with a tribological and possibly even an unfavorable coating, without this having a negative influence on the processing result of the cutting insert.

The invention now being fully described, it will be apparent to one of ordinary skill in the art that many changes and modifications can be made thereto without departing from the spirit or scope of the invention as set forth herein.

What is claimed is:

1. A method for producing an indexible cutting insert, including initially providing at least a top and sides of a basic body of the cutting insert with a wear-reducing coating that includes $Al_2O_3$; then applying a wear-indicating layer over the wear-reducing coating, with the wear-indicating layer including TiN and having a different color than the wear-reducing coating; and subsequently removing the portion of the wear-indicating layer from the top of the basic body.

2. An indexible cutting insert comprising:

a basic body including a bottom, a top, and a plurality of sides interconnecting the top and the bottom;

a wear-reducing coating disposed on the top and defining an exposed machining surface, the wear-reducing coating disposed on the top and defining an exposed machining surface, the wear-reducing coating including $Al_2O_3$;

a wear-indicating layer of TiN disposed on at least two of the sides to define exposed flank surfaces, the wear-indicating layer differing in color from the exposed machining surface and from an underlying surface of the at least two sides; and a cutting edge disposed between the top and each of the at least two side surfaces.

3. A cutting insert according to claim 2, wherein the basic body is made of a hard metal.

4. A cutting insert according to claim 2, wherein the underlying coating of each of the at least two sides is a wear-reducing coating that includes $Al_2O_3$.

5. A tool with a cutting insert according to claim 2, wherein the cutting insert is held in position, such that it determines a positive clearance angle.

6. A cutting insert according to claim 2 wherein the at least two side surfaces consist of four side surfaces.

* * * * *